US010095173B2

(12) United States Patent
Kinai

(10) Patent No.: US 10,095,173 B2
(45) Date of Patent: Oct. 9, 2018

(54) IMAGE FORMING APPARATUS INCLUDING CHARGING MEMBER LIFETIME NOTIFICATION

(71) Applicant: CANON KABUSHIKI KAISHA, Tokyo (JP)

(72) Inventor: Keisuke Kinai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/788,156

(22) Filed: Oct. 19, 2017

(65) Prior Publication Data

US 2018/0113409 A1 Apr. 26, 2018

(30) Foreign Application Priority Data

Oct. 26, 2016 (JP) ..... 2016-209151

(51) Int. Cl.
*G03G 15/00* (2006.01)
*G03G 21/00* (2006.01)

(52) U.S. Cl.
CPC ..... *G03G 15/553* (2013.01); *G03G 21/0005* (2013.01)

(58) Field of Classification Search
CPC ..... G03G 15/553; G03G 21/0005
USPC ..... 399/31, 50, 25
See application file for complete search history.

(56) References Cited

U.S. PATENT DOCUMENTS 9,939,769 B2 * 4/2018 Yoshida ..... G03G 15/553
2007/0269234 A1 * 11/2007 Kurita ..... G03G 15/0225 399/111
2017/0227907 A1 * 8/2017 Makino ..... G03G 15/0266

FOREIGN PATENT DOCUMENTS

JP 09-211931 A 8/1997
JP 11-352852 A 12/1999
JP 2005-208207 A 8/2005

* cited by examiner

*Primary Examiner* — Walter L Lindsay, Jr.
*Assistant Examiner* — Arlene Heredia Ocasio
(74) *Attorney, Agent, or Firm* — Fitzpatrick, Cella, Harper & Scinto

(57) ABSTRACT

An image forming apparatus includes an image bearing member, a charging member, an image forming portion, a notifying member, a cleaning member, a detecting member, an acquiring portion, and a controller. The charging member is disposed to be in contact with the image bearing member, and charges the image bearing member. The image forming portion forms a developer image. The notifying member notifies of information relevant to a lifetime of the charging member. The cleaning member is in contact with the image bearing member, and removes the developer on the image bearing member. The detecting member detects driving torque of the image bearing member. The acquiring portion acquires specification information relevant to a specification of the cleaning member. The controller controls the notifying member to notify of the lifetime of the charging member based on the specification information acquired by the acquiring portion and information corresponding to the driving torque of the image bearing member detected by the detecting member and the number of image formed sheets.

9 Claims, 14 Drawing Sheets

FIG. 6A

| θ [° ] | CONTACT ANGLE ϕ20° | | | | | | | | |
|---|---|---|---|---|---|---|---|---|---|
| | HARDNESS 72 | | | HARDNESS 76 | | | HARDNESS 78 | | |
| CONTACT PRESSURE [N/m] | DRIVING TORQUE 0.16[N・m] | DRIVING TORQUE 0.24[N・m] | DRIVING TORQUE 0.30[N・m] | DRIVING TORQUE 0.16[N・m] | DRIVING TORQUE 0.24[N・m] | DRIVING TORQUE 0.30[N・m] | DRIVING TORQUE 0.16[N・m] | DRIVING TORQUE 0.24[N・m] | DRIVING TORQUE 0.30[N・m] |
| 20 | 58.2 | 49.4 | 43.8 | 58.7 | 48.1 | 42.6 | 57.8 | 50.0 | 42.2 |
| 25 | 59.9 | 47.7 | 40.5 | 60.2 | 47.2 | 40.3 | 60.6 | 47.4 | 39.6 |
| 30 | 61.6 | 47.5 | 39.3 | 61.1 | 47.2 | 39.4 | 60.4 | 47.5 | 39.4 |

*FIG. 6B*

| θ [° ] | CONTACT ANGLE ϕ25° | | | | | | | | |
|---|---|---|---|---|---|---|---|---|---|
| | HARDNESS 72 | | | HARDNESS 76 | | | HARDNESS 78 | | |
| CONTACT PRESSURE [N/m] | DRIVING TORQUE 0.16[N・m] | DRIVING TORQUE 0.24[N・m] | DRIVING TORQUE 0.30[N・m] | DRIVING TORQUE 0.16[N・m] | DRIVING TORQUE 0.24[N・m] | DRIVING TORQUE 0.30[N・m] | DRIVING TORQUE 0.16[N・m] | DRIVING TORQUE 0.24[N・m] | DRIVING TORQUE 0.30[N・m] |
| 20 | 56.4 | 45.8 | 39.1 | 55.7 | 45.2 | 38.4 | 57.1 | 44.3 | 38.1 |
| 25 | 55.9 | 47.1 | 38.7 | 56.9 | 46.6 | 38.6 | 56.9 | 45.6 | 38.9 |
| 30 | 58.0 | 44.5 | 37.2 | 57.4 | 46.2 | 38.0 | 58.6 | 45.2 | 37.1 |

*FIG. 6C*

| θ [° ] | CONTACT ANGLE ϕ30° | | | | | | | | |
|---|---|---|---|---|---|---|---|---|---|
| | HARDNESS 72 | | | HARDNESS 76 | | | HARDNESS 78 | | |
| CONTACT PRESSURE [N/m] | DRIVING TORQUE 0.16[N・m] | DRIVING TORQUE 0.24[N・m] | DRIVING TORQUE 0.30[N・m] | DRIVING TORQUE 0.16[N・m] | DRIVING TORQUE 0.24[N・m] | DRIVING TORQUE 0.30[N・m] | DRIVING TORQUE 0.16[N・m] | DRIVING TORQUE 0.24[N・m] | DRIVING TORQUE 0.30[N・m] |
| 20 | 52.9 | 42.1 | 35.2 | 52.7 | 42.1 | 34.4 | 50.30 | 42.8 | 35.5 |
| 25 | 52.4 | 42.1 | 35.8 | 50.30 | 40.30 | 35.3 | 50.30 | 40.30 | 34.9 |
| 30 | 54.7 | 42.3 | 35.5 | 54.6 | 40.24 | 34.9 | 54.1 | 42.3 | 35.6 |

| | THIS EMBODIMENT | | COMPARATIVE EXAMPLE |
|---|---|---|---|
| | CONDITION 1 | CONDITION 2 | |
| HARDNESS | 70 | 75 | ABSENT |
| CONTACT PRESSURE [N/m] | 25 | 40 | ABSENT |
| CONTACT ANGLE $\phi$[°] | 25 | 25 | ABSENT |
| READING DRIVING TORQUE [N·m] | PRESENT | PRESENT | ABSENT |

| | THIS EMBODIMENT | | COMPARATIVE EXAMPLE |
|---|---|---|---|
| | CONDITION 1 | CONDITION 2 | |
| HARDNESS | 75 | 75 | 75 |
| CONTACT PRESSURE [N/m] | 40 | 40 | 40 |
| CONTACT ANGLE $\phi$[°] | 25 | 25 | 25 |
| IMAGE PRINTING RATE [%] | 10 | 3 | ABSENT |
| READING DRIVING TORQUE [N·m] | PRESENT | PRESENT | PRESENT |

IMAGE FORMING APPARATUS INCLUDING CHARGING MEMBER LIFETIME NOTIFICATION

BACKGROUND OF THE INVENTION

Field of the Invention

The present invention relates to an image forming apparatus such as an electrophotographic copying machine and an electrophotographic printer (for example, a laser beam printer, an LED printer, and the like). In particular, the invention relates to controlling of determining a lifetime of a charging member of the image forming apparatus.

Description of the Related Art

In an image forming apparatus using an electrophotographic system, a charging roller of a contact charging system has been widely used as a charging member charging a photosensitive drum (an image bearing member).

In such an image forming apparatus, in order to continuously form an excellent image, it is necessary to perform replacement or refill of consumable supplies according to the setting of a lifetime of each apparatus or member. It is also necessary to replace the charging roller according to the lifetime. Therefore, a method of determining the lifetime has been proposed from the related art. For example, in Japanese Patent Laid-Open No. H09-211931, a configuration is described in which in the lifetime of the charging roller, it is determined that the lifetime is over when an applying time of a charged voltage applied to the charging roller and an integration value of the number of rotations of the charging roller reach a certain reference value.

An example of one factor affecting the lifetime of the charging roller is the occurrence of a charging failure by attaching toner onto a front surface of the charging roller. In a case where the charging failure occurs, vertical streak-like toner slipping occurs, and thus, the image failure is caused. Such attachment of the toner with respect to the charging roller considerably affects a variation in a physical property value of a cleaning blade which removes the toner on the photosensitive drum by scraping the toner, and a usage condition of the image forming apparatus.

For this reason, as with the configuration described in Japanese Patent Laid-Open No. H09-211931, in a case where the lifetime is determined by only information such as an applying time of a charging bias or the number of rotations of the charging roller, the lifetime determined according to the physical property value of the cleaning blade or the usage condition does not accord to an actual condition.

SUMMARY OF THE INVENTION

It is desirable to provide an image forming apparatus which is capable of accurately determining a lifetime of a charging member.

A representative configuration of the present invention is an image forming apparatus including:

- an image bearing member;
- a charging member which is disposed to be in contact with the image bearing member, and charges the image bearing member;
- an image forming portion which forms an electrostatic latent image based on image information on the charged image bearing member, and then, attaches a developer to the electrostatic latent image to form a developer image;

- a notifying member which notifies of information relevant to a lifetime of the charging member;
- a cleaning member which is in contact with the image bearing member, and removes the developer on the image bearing member;
- a detecting member which detects driving torque of the image bearing member;
- an acquiring portion which acquires specification information relevant to a specification of the cleaning member; and
- a controller which controls the notifying member to notify of the lifetime of the charging member based on the specification information acquired by the acquiring portion and information corresponding to the driving torque of the image bearing member detected by the detecting member and the number of image formed sheets.

Further features of the present invention will become apparent from the following description of exemplary embodiments with reference to the attached drawings.

BRIEF DESCRIPTION OF THE DRAWINGS

FIGS. 6A to 6C are tables including table data of an angle θ which is prepared based on a specification of the cleaning blade and driving torque of the photosensitive drum.

DESCRIPTION OF THE EMBODIMENTS

First Embodiment

<Image Forming Apparatus>

Hereinafter, first, the entire configuration of an image forming apparatus according to a first embodiment of the invention will be described along with an operation at the time of forming an image, with reference to the drawings. Furthermore, the described dimension, material, shape, relative arrangement, and the like of constituents are not intended to be limited to the scope of the invention, unless otherwise particularly described.

An image forming apparatus A is a color image forming apparatus of an intermediate transfer tandem system in which toners (developers) of four colors of yellow Y, magenta M, cyan C, and black K are primarily transferred to an intermediate transfer belt, and then, are secondarily transferred to a sheet as a recording medium, and thus, an image is formed. In the following description, symbols of Y, M, C, and K representing the color of the toner will be suitably omitted.

Figure 1:
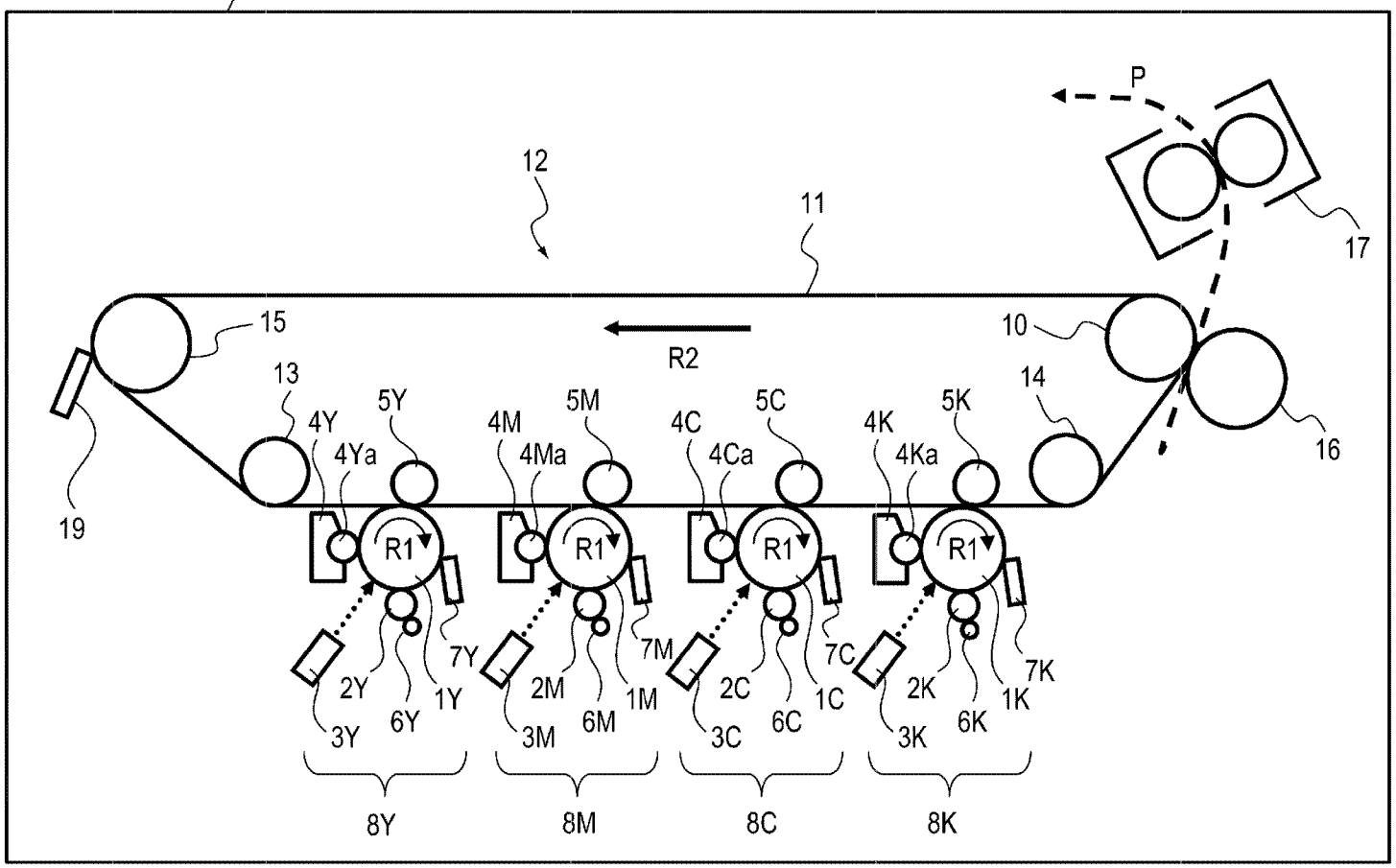
FIG. 1 is a sectional schematic view of an image forming apparatus.

As illustrated in FIG. 1, the image forming apparatus A includes an image forming portion which transfers a toner image to a sheet, a sheet feeding portion which supplies the sheet to the image forming portion, and a fixing portion which fixes the toner image to the sheet.

The image forming portion includes an image forming unit 8 (8Y, 8M, 8C, and 8K) detachably attachable to a main body of the image forming apparatus A (an apparatus main body), an intermediate transfer unit 12, a laser scanner unit 3 (3Y, 3M, 3C, and 3B), a developing apparatus 4 (4Y, 4M, 4C, and 4K), and the like.

In the image forming unit 8, a photosensitive drum 1 (1Y, 1M, 1C, and 1B), a charging roller 2 (2Y, 2M, 2C, and 2K), a cleaning blade 7 (7Y, 7M, 7C, and 7B), and a charging roller cleaning member 6 (6Y, 6M, 6C, and 6B) are unitized. In addition, the image forming unit 8 includes a memory portion 33 (refer to FIG. 3) which stores physical property value information or setting value information of a member configuring the image forming unit 8. The information stored in the memory portion 33 will be described below.

The photosensitive drum 1 (an image bearing member) is an organic photoconductor (OPC) drum, and has an outer diameter of 30 mm. In addition, the photosensitive drum 1 includes a photosensitive layer of which a charging polarity is a negative polarity on a front surface, and is rotatively driven around a center spindle in a direction of an arrow R1 at a process speed of 263 mm/sec by a driving motor (not illustrated).

In the charging roller 2 (a charging member), both end portions of a core metal are rotatably retained by the bearing member (not illustrated), are biased in a direction of the photosensitive drum 1 by a pressing spring (not illustrated), and thus, are pressed against the front surface of the photosensitive drum 1 with a predetermined pressing force. The charging roller 2 is rotated according to the rotation of the photosensitive drum 1, and uniformly charges the front surface of the photosensitive drum 1. Furthermore, a stainless steel round bar having a diameter of 6 mm is used as the core metal, carbon is dispersed to a fluorine resin as a surface layer, and an outer diameter is 14 mm and roller resistance is $10^4\Omega$ to $10^7\Omega$ as a roller.

In addition, in general, it is known that the surface layer of the charging roller 2 has a concave and convex shape, and thus, a pressure in a concave portion and the photosensitive drum 1 is reduced, and the contamination of the charging roller 2 can be reduced. Examples of a method of forming concavities and convexities include a method of containing fine particles in the surface layer, and a method of performing processing by using mechanical polishing. The charging roller 2 of this embodiment has a concave and convex shape having a maximum height Rz (JIS B0601: 2001) of approximately 15 μm on the surface.

The charging roller cleaning member 6 is disposed to be in contact with the charging roller 2, and removes the toner attached to the charging roller 2 while being driven to be rotated when the charging roller 2 is rotated. In this embodiment, a main component of the charging roller cleaning member 6 is a general foaming sponge, and has an outer diameter of 6 mm.

The cleaning blade 7 (a cleaning member) is disposed to be in contact with the photosensitive drum 1, and removes the toner on the photosensitive drum 1 by scraping the toner when the photosensitive drum 1 is rotated. The cleaning blade 7 is configured of a plate-like rubber member and a support sheet metal, and as the rubber member, for example, urethane rubber having hardness 77° (JIS-A) and a thickness of 2 mm is used. The hardness can be measured by performing depressed deformation with respect to the front surface with an indenter, and by measuring a deformation amount (a depressed depth).

Figure 2:
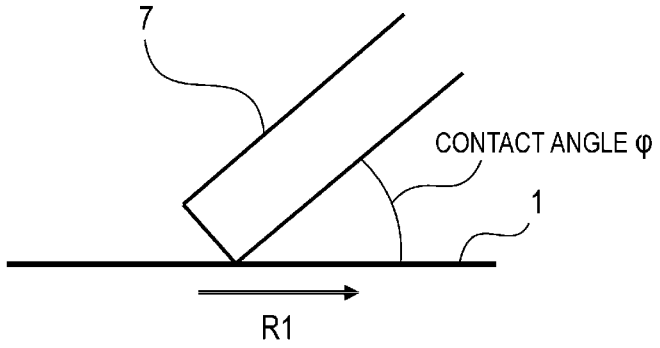
FIG. 2 is a diagram describing a contact angle with respect to a photosensitive drum of a cleaning blade.

FIG. 2 is a diagram describing a contact angle with respect to the photosensitive drum 1 of the cleaning blade 7. As illustrated in FIG. 2, the cleaning blade 7 is in contact with the front surface of the photosensitive drum 1 at a contact angle $\phi$ of greater than or equal to 18° and less than or equal to 35°. The contact angle $\phi$ can be measured by irradiating a contact portion between the cleaning blade 7 and an end portion of the photosensitive drum 1 in a longitudinal direction with laser light, and by measuring a reflection intensity thereof. Specifically, an average value of measured values obtained from both end portions is set to the contact angle $\phi$.

In addition, the cleaning blade 7 is in contact with the photosensitive drum 1 at a pressure (a contact pressure) of greater than or equal to 14.7 N/m and less than or equal to 44.1 N/m. In the contact pressure, a pressure when the cleaning blade 7 abuts on a load cell divided into five in the longitudinal direction is measured, and an average value of five points is set to the contact pressure. A measured value thereof is changed according to a dimensional variation in the member, or the like, and thus, is measured at the time of assembling the image forming unit 8, and the hardness of the cleaning blade 7, the contact angle $\phi$ with respect to the photosensitive drum 1, and the contact pressure are stored in a memory portion 33 of the image forming unit 8 from the measured value. That is, specification information relevant to a specification of the cleaning blade is stored in the memory portion 33. Furthermore, the measurement method described above can be suitably performed according to a configuration of an apparatus to which the invention is applied or various conditions.

The developing apparatus 4 develops an electrostatic latent image formed on the photosensitive drum 1. The developing apparatus 4 includes a two-component developer including a non-magnetic toner of which a charging polarity is a negative polarity and a magnetic carrier. In addition, the developing apparatus 4 includes a developing sleeve 4*a* in a position separated from the photosensitive drum 1 at a predetermined distance to face the photosensitive drum 1. Furthermore, in this embodiment, a negative charging toner having an average particle diameter of 5.5 μm is used as the toner, and a magnetic carrier having saturated magnetization of 205 emu/cm$^3$ and an average particle diameter of 35 μm is used as the carrier. In addition, the toner and the carrier are mixed at a weight ratio of 6:94, and are used as a developer.

The intermediate transfer unit 12 includes a primary transfer roller 5 (5Y, 5M, 5C, and 5K), a secondary transfer roller 16, a secondary transfer counter roller 10, an intermediate transfer belt 11, a cleaning apparatus 19, and the like. The intermediate transfer belt 11 is an endless belt, is stretched by the secondary transfer counter roller 10, a first stretching roller 13, a second stretching roller 14, and a tension roller 15, and is revolvably moved in a direction of an arrow R2 illustrated in FIG. 1 by a driving force which is transmitted to a secondary transfer counter roller 9.

The cleaning apparatus 19 faces the tension roller 15 through the intermediate transfer belt 11, is in contact with the intermediate transfer belt 11 in a counter direction to a movement direction, and collects the toner on the intermediate transfer belt 11. The cleaning apparatus 19 is configured of a plate-like rubber member and a support sheet metal, and for example, urethane rubber having hardness 77° (JIS-A) and a thickness of 2 mm is used as the rubber member. In addition, in the cleaning apparatus 19, a contact edge of the rubber member is in contact with the intermediate transfer belt 11 at an angle of greater than or equal to 18° and less than or equal to 35° and a linear pressure of greater than or equal to 4.7 N/m and less than or equal to 44.1 N/m.

Next, an image forming operation will be described. When an image is formed, first, in a case where a controller 20 illustrated in FIG. 3 receives an image forming job signal, a sheet P stacked and stored in a sheet stacking portion (not illustrated) is fed to the image forming portion by a feeding roller (not illustrated) and a transport roller (not illustrated).

In the image forming portion, a direct current voltage of a negative polarity is applied to the charging roller 2, and thus, the front surface of the photosensitive drum 1 is charged. Next, the laser scanner unit 3 allows the laser light to exit from a light source (not illustrated) provided in the laser scanner unit 3, and irradiates the photosensitive drum 1 with the laser light according to image information. Accordingly, an electrostatic latent image according to the image information is formed on the front surface of the photosensitive drum 1.

The electrostatic latent image is developed by attaching the toner to the electrostatic latent image with the developing apparatus 4, and thus, a toner image (a developer image) is formed on the photosensitive drum 1. Specifically, the developer in the developing apparatus 4 is subjected to frictional charging, is transported by a transport member (not illustrated), and is supported on the developing sleeve 4*a*. After that, in the developer supported on the developing sleeve 4*a*, a vibration voltage in which an alternate current voltage is superimposed on a direct current voltage of a negative polarity is applied to the developing sleeve 4*a*, and thus, the toner charged to a negative polarity is moved to an electrostatic latent image portion of the photosensitive drum 1 which relatively becomes a positive polarity, and the electrostatic latent image is reversely developed.

In a primary transfer portion formed by the photosensitive drum 1 and the primary transfer roller 5, a direct current voltage of a positive polarity which is opposite to the charging polarity of the toner is applied to the primary transfer roller 5, and thus, each toner image formed on the photosensitive drum 1 is primarily transferred to the intermediate transfer belt 11.

The intermediate transfer belt 11 is moved in the direction of the arrow R2 according to the rotation of the secondary transfer counter roller 10, and thus, the primarily transferred toner image reaches a secondary transfer portion formed by the secondary transfer counter roller 10 and the secondary transfer roller 16. Then, in the secondary transfer portion, a direct current voltage of a positive polarity which is opposite to the charging polarity of the toner is applied to the secondary transfer roller 16, and thus, the toner image is transferred to the sheet P.

The sheet P to which the toner image is transferred is curvedly separated from the intermediate transfer belt 11, and then, is fed to a fixing apparatus 17, and is heated, pressured, melted, and mixed, and the toner image is fixed to the sheet P as a permanent image. After that, the sheet P is discharged to the outside of the image forming apparatus A.

In addition, the toner remaining on the photosensitive drum 1 after the primary transfer is removed by the cleaning blade 7. In addition, the toner remaining on the intermediate transfer belt 11 after the secondary transfer is removed by the cleaning apparatus 19.

<Controller>

Next, a control system of the image forming apparatus A will be described.

Figure 3:
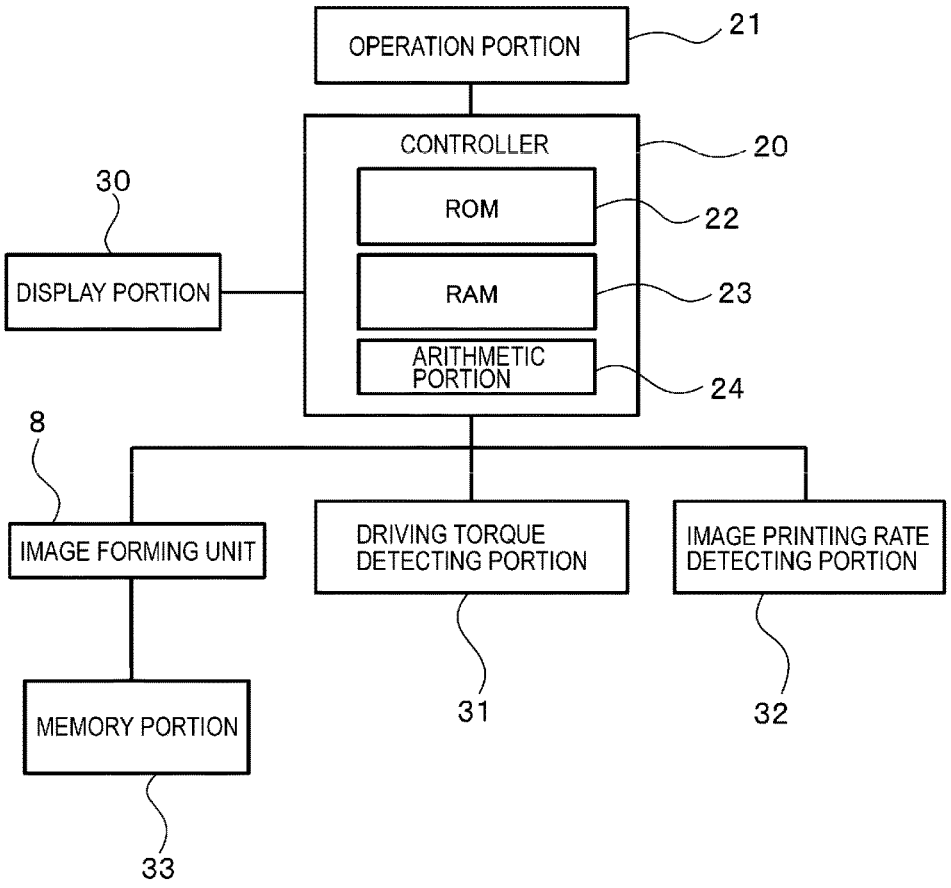
FIG. 3 is a block diagram illustrating a configuration of a part of a control system of the image forming apparatus.

FIG. 3 is a block diagram illustrating a configuration of a part of the control system of the image forming apparatus A. As illustrated in FIG. 3, the image forming apparatus A includes the controller 20. The controller 20 includes a ROM 22, a RAM 23, and an arithmetic portion 24. Setting values and the like required for various controls are recorded in the ROM 22, and as necessary, are called by the controller 20. Various data items such as the number of image formed sheets changed according to the image forming operation and an image printing rate are temporarily recorded in the RAM 23, and are used for various controls. The arithmetic portion 24 performs arithmetic required for various controls.

An operation portion 21, a driving torque detecting portion 31 (a detecting member), a display portion 30 (a notifying member), and an image printing rate detecting portion 32 are connected to the controller 20. A user operates the operation portion 21, and thus, an image forming job can be executed, and the controller 20 receives a signal from the operation portion 21 and operates various devices of the image forming apparatus A. In addition, the display portion 30 displays various information items such as information relevant to a lifetime of the charging roller 2. In addition, the image printing rate detecting portion 32 detects a printing rate of the image to be formed.

In addition, the driving torque detecting portion 31 detects the driving torque of the photosensitive drum 1 as a driving load of the photosensitive drum 1. In this embodiment, the driving torque detecting portion 31 uses the fact that a proportional relationship is established between the driving torque of the photosensitive drum 1 and the current value flowing through the driving motor driving the photosensitive drum 1, and calculates the driving torque by detecting the current value. Furthermore, a detecting method of the driving torque is not limited to the method described above, and the driving torque may be detected by other methods.

In addition, the memory portion 33 (a storing portion) is connected to the controller 20 through the image forming unit 8. In a case where the image forming unit 8 is mounted on the main body of the image forming apparatus A, the specification information of the cleaning blade 7 stored in the memory portion 33, that is, the hardness, the contact angle $\phi$, and the contact pressure are read by the controller 20. That is, the controller 20 is an acquiring portion which acquires the specification information of the cleaning blade 7.

<Number of Toner Slippings>

Next, a method of calculating the number of toner slippings, which is one of parameters used for calculating the lifetime of the charging roller 2 described below, will be described. In the number of toner slippings, a toner amount (a developer amount) of the toner on the photosensitive drum 1 (the image bearing member), which slips through the cleaning blade 7 and reaches the charging roller 2, is represented as the number of toners.

Figure 4:
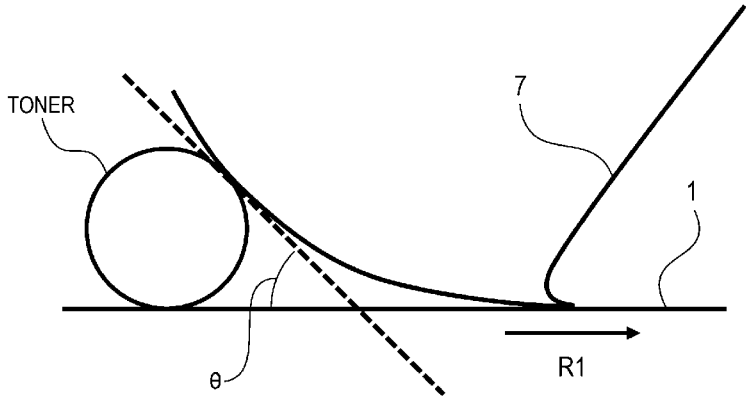
FIG. 4 is an explanatory diagram for describing a relationship between a toner on the photosensitive drum and the cleaning blade.

FIG. 4 is an explanatory diagram for describing a relationship between the toner on the photosensitive drum 1 and the cleaning blade 7. As illustrated in FIG. 4, an angle between a tangent line at a point where the toner on the photosensitive drum 1 is in contact with the cleaning blade 7 and the front surface of the photosensitive drum 1 is defined as an angle θ. The angle θ is related to the degree of a force at which the toner is pushed back by the cleaning blade 7.

Figure 5A:
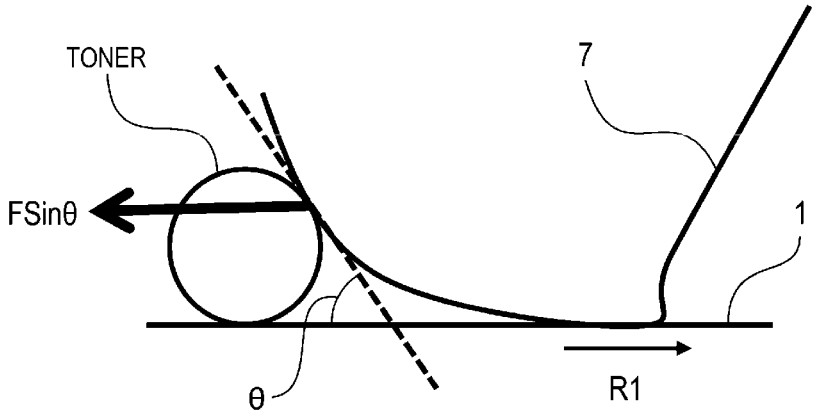
FIGS. 5A and 5B are explanatory diagrams for describing the relationship between the toner on the photosensitive drum and the cleaning blade.
Figure 5B:
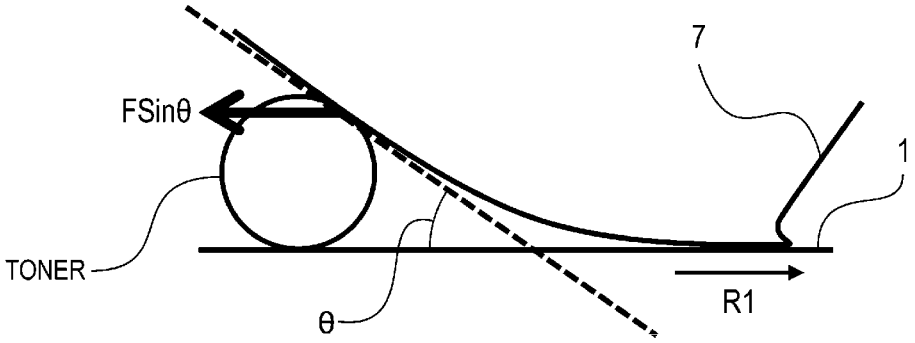

FIGS. 5A and 5B are explanatory diagrams for describing a relationship between the toner on the photosensitive drum 1 and the cleaning blade 7 in a case where the angle θ is large (FIG. 5A) and in a case where the angle θ is small (FIG. 5B). As illustrated in FIGS. 5A and 5B, the force at which the toner is pushed back by the cleaning blade 7 can be represented by F sin θ, and in a case of being compared with the magnitude of the angle θ, the F sin θ increases in a case where the angle θ is large. Thus, the angle θ is related to the force at which the toner is pushed back by the cleaning blade 7, and thus, it is considered that there is a correlation between the angle θ and the number of toner slippings.

Therefore, the angle θ is obtained. In this embodiment, in order to obtain the angle θ, calculation is performed by using three-dimensional finite element analysis tool Abaqus (manufactured by OTSUKA CORPORATION as CAD Japan). Specifically, the hardness of the cleaning blade 7, the contact angle ϕ with respect to the photosensitive drum 1, the contact pressure, and a frictional force between the cleaning blade 7 and the photosensitive drum 1 are assumed as an input, and the angle θ is calculated by inputting several patterns, and thus, table data α illustrated in FIGS. 6A to 6C is prepared. The table data α is stored in advance in the ROM 22, and is in a state of being read out when the image forming apparatus A is used. In this embodiment, the frictional force between the photosensitive drum 1 and the cleaning blade 7 is changed to the driving torque of the photosensitive drum 1, and a table is prepared by dividing the hardness of the cleaning blade 7, the contact angle ϕ, and the contact pressure into three, and by dividing the driving torque of the photosensitive drum into three. Furthermore, in a case where the value is within the division at the time of reading out the data, the value is used by being subjected to linear interpolation. The controller 20 determines the angle θ with reference to the table data α in which the driving torque of the photosensitive drum 1, the specification information of the cleaning blade 7, and the angle θ are associated each other.

Figure 7:
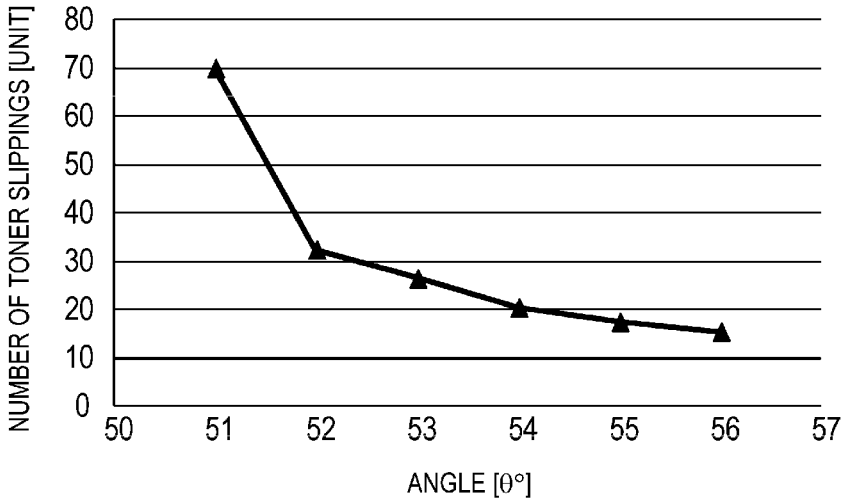
FIG. 7 is a graph illustrating correlation data between the angle θ and the number of toner slippings.

Next, correlation data between the angle θ and the number of toner slippings is acquired. FIG. 7 is a graph illustrating the correlation data between the angle θ and the number of toner slippings. As a method of acquiring the correlation data, a constant amount of toner is supplied in the configuration of several patterns such that the angle θ calculated by the method described above is formed to be several patterns, and the number of toners slipping through the cleaning blade 7 is measured. In this embodiment, a toner applied amount is set to 0.45 mg/cm$^2$, and the toner is supplied for 5 seconds. The number of toner slippings increases and decreases according to a measurement range, but in this embodiment, number of toner slippings is set to the number of toners within in a range of 700 μm×700 μm. In addition, the measured number of toner slippings is adjusted according to a density of a transfer residual toner. The correlation data obtained as described above is stored in the ROM 22 as table data β, and is in a state of being read out.

As illustrated in FIG. 7, in the table data β, in a case where the angle θ is small, the number of toner slippings increases compared to a case where the angle θ is large. As described above, it is considered that this is because in a case where the angle θ is large, the force at which the toner is pushed back by the cleaning blade 7 increases compared to a case where the angle θ is small. The controller 20 determines the number of toner slippings based on the angle θ, with reference to the table data β. That is, the controller 20 determines that in a case where the angle θ is small, the number of toner slippings increases compared to a case where the angle θ is large.

As described above, the hardness of the cleaning blade 7, the contact angle ϕ, and the contact pressure are acquired from the memory portion 33, the driving torque is detected by the driving torque detecting portion 31, and thus, the number of toner slippings at the time of forming an image can be determined with reference to the table data α and β.

<Number of Toners Attached to Charging Roller>

Next, a calculation method of the number of toners attached to the charging roller 2 will be described.

First, a rate that the toner slipping through the cleaning blade 7 is attached to the charging roller 2 is measured in advance as an attachment rate γ. In a measurement method, the charging roller cleaning member 6 and the cleaning blade 7 are detached, the toner is supplied to the photosensitive drum 1 by the image forming operation, and the number of toners attached to the charging roller 2 is measured within a range of 700 μm×700 μm, as with the measurement of the number of toner slippings. After that, the number of toners attached to the charging roller 2 is divided by the number of supplied toners, and thus, the rate is obtained. In this embodiment, the attachment rate γ is 0.8 (80%).

In addition, a rate that the charging roller cleaning member 6 collects the toner is measured in advance as a collection rate ε based on the number of toners N[i] attached to the charging roller 2 when the number of image formed sheets is i. In a measurement method, the toner is attached to the charging roller 2, the developing apparatus 4 is detached in order to block the supply of the toner, and then, the number of toners collected by the charging roller cleaning member 6 is subjected to data fitting in Expression 1 described below, and thus, the collection rate ε is obtained. In this embodiment, the collection rate ε is 0.5 (50%).

$$N[i]=-\varepsilon N[i-1] \tag{1}$$

Next, in a case where the number of image formed sheets is i, the number of toner slippings obtained by the method described above is set to S[i], and the number of toners N[i] attached to the charging roller 2 is calculated by using Expression 2 described below based on the attachment rate γ and the collection rate ε.

$$N[i]=\gamma S[i]-\varepsilon N[i-1] \tag{2}$$

As described above, the number of toners N[i] attached to the charging roller 2 when the number of image formed sheets is i can be calculated.

<Lifetime Determination Sequence>

Next, a lifetime determination sequence of determining the lifetime of the charging roller 2 will be described by using a flowchart illustrated in FIG. 8.

Figure 8:
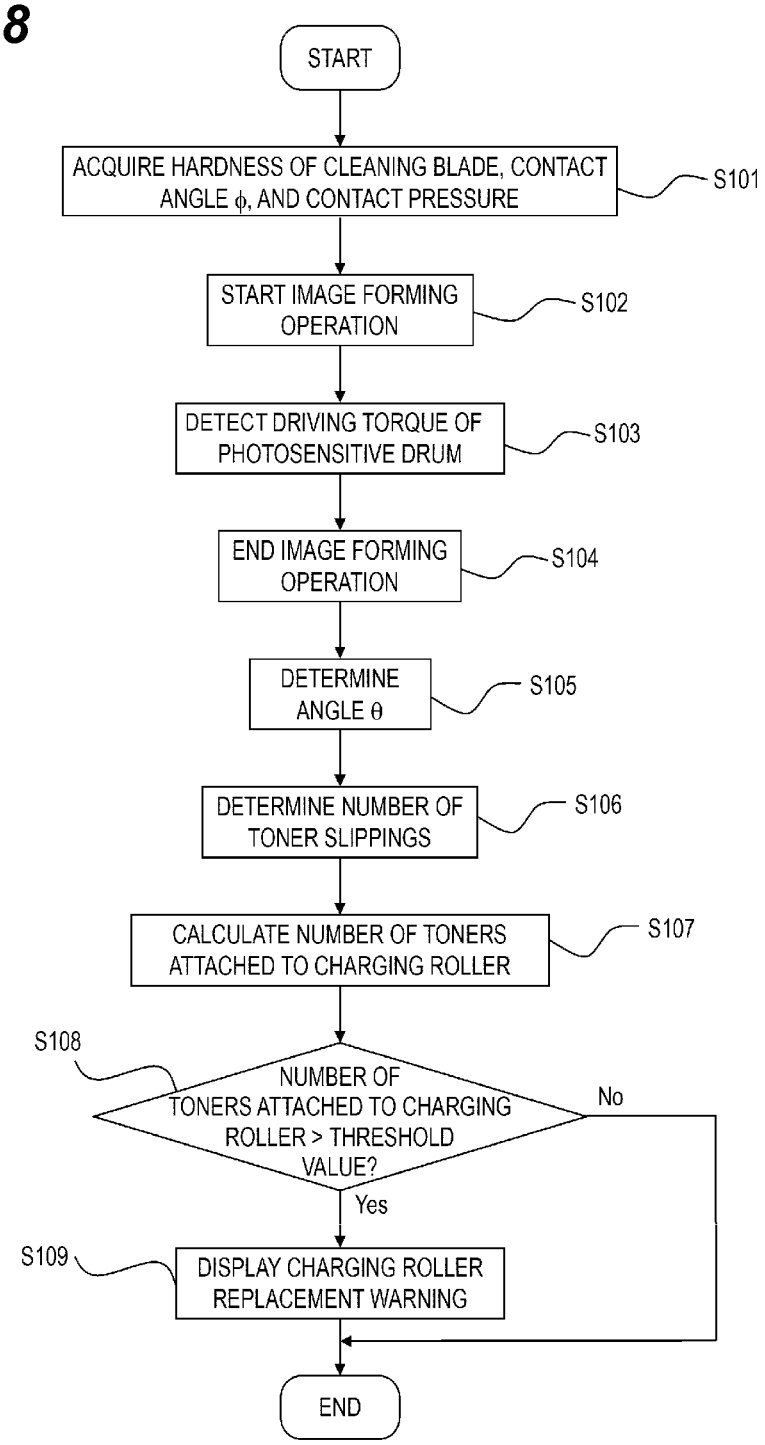
FIG. 8 is a flowchart of a lifetime determination sequence.

As illustrated in FIG. 8, first, in a case where the image forming unit 8 is mounted on the main body of the image forming apparatus A, the controller 20 reads out and acquires the hardness of the cleaning blade 7, the contact angle ϕ, and the contact pressure from the memory portion 33 of the image forming unit 8 (S101).

Next, the controller 20 receives the image forming job, and starts the image forming operation (S102), and in a case where the photosensitive drum 1 is started to be rotatively driven, the driving torque detecting portion 31 detects the driving torque of the photosensitive drum 1 (S103).

Next, after the image forming operation is ended (S104), the controller 20 determines the size of the angle θ based on the detected driving torque, the acquired hardness of the cleaning blade 7, contact angle ϕ, and contact pressure, with reference to the table data α stored in the ROM 22 (S105). After that, the controller 20 determines the number of toner slippings based on the determined size of the angle θ, with reference of the table data β stored in the ROM 22 (S106).

Next, the number of toners attached to the charging roller 2 is calculated by the arithmetic portion 24 based on the determined number of toner slippings, the number of image formed sheets, or the like, by using Expression 2 described above (S107). The calculated number of toners is also used for the arithmetic of the next image forming operation, and thus, is stored in the RAM 23.

Next, the controller 20 determines whether or not the number of toners attached to the charging roller 2 is greater than a threshold value set in advance (S108). Here, in a case where the number of toners attached to the charging roller 2 is greater than the threshold value, the charging roller 2 is contaminated with the toner, and thus, a charging roller replacement warning of notifying that the charging roller 2 is on the brink of replacement is displayed on the display portion 30 (S109). On the other hand, in a case where the number of toners N attached to the charging roller 2 is less than the threshold value, the lifetime of the charging roller 2 is not yet over, and thus, the next image formation is prepared.

Furthermore, such determination of the lifetime is not only displayed on the display portion 30, but is also capable of being used in an automated delivery trigger or unit for allowing a serviceman or the user to expect a replacement timing. That is, any configuration may be used insofar as the information relevant to the lifetime calculated by the method described above is notified by the configuration.

Thus, in the configuration of this embodiment, the lifetime determination is performed in consideration of the attachment of the toner with respect to the charging roller 2, and thus, it is possible to accurately determine the lifetime of the charging roller 2 compared to the configuration of the related art.

<Result of Comparison Experiment of Lifetime Determination>

Next, a result of a comparison experiment will be described in which the comparison of the lifetime determination is performed by the configuration of this embodiment in which the lifetime determination is performed by the lifetime determination sequence described above, and a configuration of a comparative example in which the lifetime determination is performed based on a charging time as with the related art. Furthermore, in this experiment, a toner of a cyan color is used, five continuous images are repeatedly operated at a toner applied amount of 0.05 mg/cm$^2$, and sheet passing is performed until an image failure occurs.

Figures 9A, 9B:
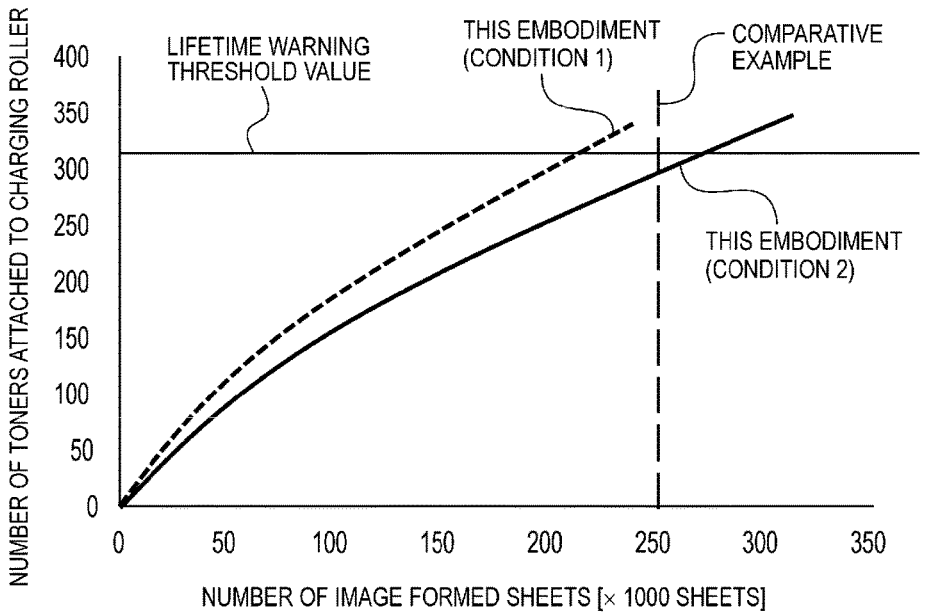
FIGS. 9A and 9B are a table and a graph representing a result of a comparison experiment of lifetime determination.

FIGS. 9A and 9B are a table and a graph representing the result of the comparison experiment of the lifetime determination. In this experiment, as illustrated in FIG. 9A, in the configuration of this embodiment, the experiment is performed in two conditions of a condition 1 and a condition 2. As illustrated in FIG. 9B, in the configuration of the comparative example, when 250,000 images are formed, lifetime over determination is performed. In contrast, in the configuration of this embodiment, in a case of the condition 1, the lifetime over determination is performed at a time point where 200,000 images are formed. In such a case where an image is formed in the condition 1, in the configuration of the comparative example, in a case where the image formation is performed after 200,000 sheets, an image failure occurs according to the lifetime of the charging roller.

In addition, in a case of the condition 2, the lifetime over determination is performed at a time point where 280,000 images are formed. In such a case where an image is formed in the condition 2, in the configuration of the comparative example, the lifetime over determination is performed when the number of images is 250,000 even though the lifetime of the charging roller 2 is originally not over until the number of image formed sheets reaches 280,000, and thus, an extra cost for replacing the image forming unit 8 is required.

In contrast, in the configuration of this embodiment, the lifetime determination is performed in consideration of the attachment of the toner with respect to the charging roller 2, and thus, an image failure based on a charging failure can be suppressed, and a replacement cost based on the initial replacement of the charging roller 2 can be reduced.

As described above, according to the invention, it is possible to calculate the lifetime of the charging roller 2 according to a physical property value of the cleaning blade 7 or a usage condition of the image forming apparatus A, and to accurately determine the lifetime compared to the related art.

Second Embodiment

Next, a second embodiment of the image forming apparatus A according to the invention will be described by using the drawings. The same reference numerals are applied to the same portions as those of the first embodiment described above, and the description thereof will be omitted.

A density value of an image at the time of using the image forming apparatus A, that is, the printing rate is various, and the number of toner slippings increases and decreases according to the printing rate of the image. That is, in a case where the printing rate of the image to be formed increases, the toner amount supplied to the cleaning blade 7 increases, and thus, the number of toner slippings also increases. Therefore, in this embodiment, the lifetime is calculated in consideration of the printing rate of the image in addition to the control of the first embodiment.

Figure 10:
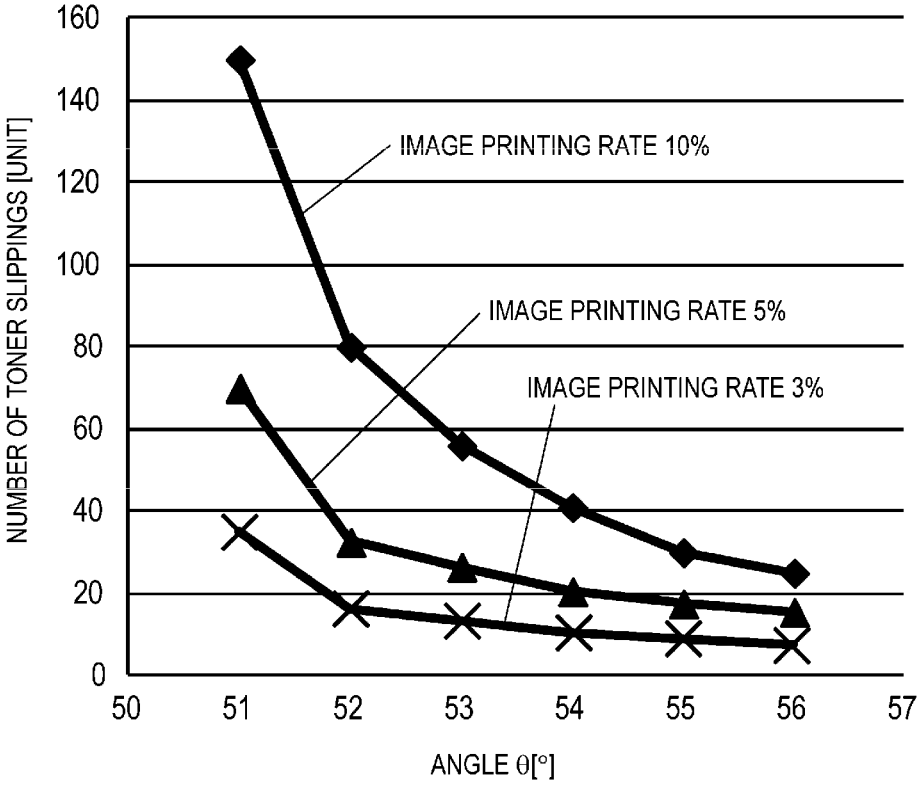
FIG. 10 is a graph illustrating correlation data of the angle θ, a printing rate of an image, and the number of toner slippings.

The printing rate of the image is considered, and thus, correlation data of angle θ, the printing rate of the image, and the number of toner slippings is acquired in advance. FIG. 10 is a graph illustrating the correlation data of the angle θ, the printing rate of the image, and the number of toner slippings. An acquisition method of the correlation data is the same method as the method described above of acquiring the correlation data between the angle θ and the number of toner slippings, and performs measurement while changing the image printing rate. The correlation data obtained as described above is stored in the ROM 22 as table data ω, and is in a state of being read out.

Figure 11:
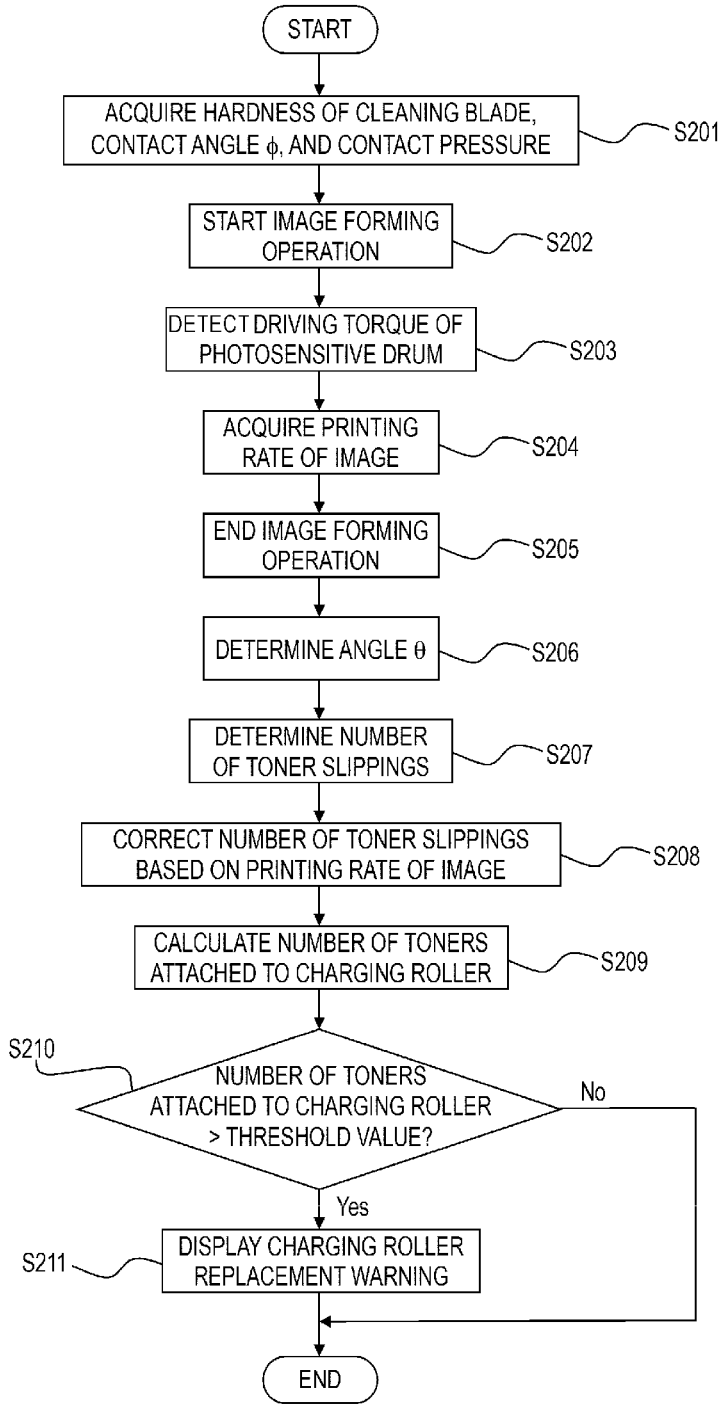
FIG. 11 is a flowchart of the lifetime determination sequence.

Next, a lifetime determination sequence of this embodiment will be described by using a flowchart illustrated in FIG. 11. As illustrated in FIG. 11, first, the image forming unit 8 is mounted on the main body of the image forming apparatus A, and the controller 20 reads out and acquires the hardness of the cleaning blade 7, the contact angle ϕ, and the contact pressure from the memory portion 33 (S201). After that, the angle θ is determined in the same sequence as that of the lifetime determination sequence according to the first embodiment (S202 to S206).

Next, the number of toner slippings is determined from the determined angle θ and the printing rate of the image acquired at the time of the image forming operation (S204), with reference to the table data ω described above (S207 and S208). At this time, in a case where a value is within a data section, linear interpolation is performed. That is, a determination value of the number of toner slippings is corrected based on the printing rate (the density value) of the formed image. Specifically, in a case where the printing rate of the image is large, the number of toner slippings is corrected such that the number of toner slippings increases compared to a case where the printing rate of the image is small.

The number of toners attached to the charging roller 2 is calculated by the arithmetic portion 24 based on the number of toner slippings obtained as described above, the number of image formed sheets, or the like, by using Expression 2 described above (S209).

After that, the controller 20 determines whether or not the number of toners attached to the charging roller 2 is greater than a threshold value set in advance (S210). Here, in a case where the number of toners N attached to the charging roller 2 is greater than the threshold value, the charging roller 2 is contaminated with the toner, and thus, the charging roller replacement warning of notifying that the charging roller 2 is on the brink of replacement is displayed on the display portion 30 (S211). On the other hand, in a case where the number of toners N attached to the charging roller 2 is less than the threshold value, the lifetime of the charging roller 2 is not yet over, and thus, the next image formation is prepared.

<Result of Comparison Experiment of Lifetime Determination>

Next, a result of a comparison experiment will be described in which the comparison of the lifetime determination is performed by the configuration of this embodiment in which the lifetime determination is performed by the lifetime determination sequence described above, and a configuration of a comparative example in which the lifetime determination is performed by the lifetime determination sequence of the first embodiment. Furthermore, in this experiment, a toner of a cyan color is used, five continuous images are repeatedly operated at a toner applied amount of 0.05 mg/cm$^2$, and sheet passing is performed until an image failure occurs.

Figures 12A, 12B:
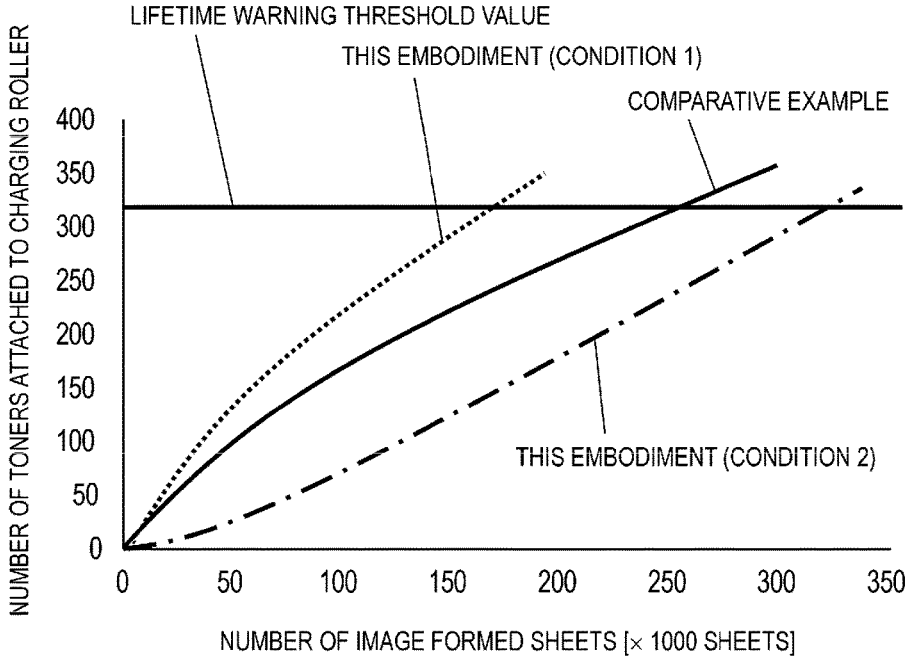
FIGS. 12A and 12B are a table and a graph representing the result of the comparison experiment of the lifetime determination.

FIGS. 12A and 12B are a table and a graph representing the result of the comparison experiment of the lifetime determination. In this experiment, as illustrated in FIG. 12A, in the configuration of this embodiment, the experiment is performed in two conditions of the condition 1 and the condition 2, and in the configuration of the comparative example, the experiment is performed in a condition corresponding to the condition 2 illustrated in FIG. 9A.

As illustrated in FIG. 12B, in the configuration of the comparative example, when 280,000 images are formed, the lifetime over determination is performed. In contrast, in the configuration of this embodiment, in a case of the condition 1, the lifetime over determination is performed at a time point where 160,000 images are formed. In such a case where the image is formed in the condition 1, in the configuration of the comparative example, in a case where the image formation is performed after 160,000, an image failure occurs according to the lifetime of the charging roller.

In addition, in a case of the condition 2, the lifetime over determination is performed at a time point where 320,000 images are formed. In such a case where the image is formed in the condition 2, in the configuration of the comparative example, the lifetime over determination is performed when the number of images is 280,000 even though the lifetime of the charging roller 2 is originally not over until the number of image formed sheets reaches 320,000, and thus, an extra cost for replacing the image forming unit 8 is required.

In contrast, in the configuration of this embodiment, the lifetime determination is performed in consideration of the attachment of the toner with respect to the charging roller 2 while considering the printing rate of the image, and thus, an image failure based on a charging failure can be suppressed, and a replacement cost based on the initial replacement of the charging roller 2 can be reduced.

As described above, according to the invention, it is possible to calculate the lifetime of the charging roller 2 according to the physical property value of the cleaning blade 7 or the usage condition of the image forming apparatus A even under a usage condition where the printing rate of the image is various, and to accurately determine the lifetime compared to the related art.

Furthermore, in the first embodiment and the second embodiment described above, the lifetime is calculated based on the number of image formed sheets, but the invention is not limited thereto. That is, even in a case where the lifetime is calculated by substituting the number of image formed sheets, for example, with information corresponding to the number of image formed sheets, such as rotation time of the photosensitive drum 1 or the charging roller 2, the same effect described above can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-209151, filed Oct. 26, 2016, which is hereby incorporated by reference herein in its entirety.

What is claimed is:

1. An image forming apparatus, comprising:

an image bearing member;

a charging member which is disposed to be in contact with the image bearing member, and charges the image bearing member;

an image forming portion which forms an electrostatic latent image based on image information on the charged image bearing member, and then attaches a developer to the electrostatic latent image to form a developer image;

a notifying member which notifies of information relevant to a lifetime of the charging member;

a cleaning member which is in contact with the image bearing member, and removes the developer on the image bearing member;

a detecting member which detects driving torque of the image bearing member;

an acquiring portion which acquires specification information relevant to a specification of the cleaning member; and a controller which controls the notifying member to notify of the lifetime of the charging member based on the specification information acquired by the acquiring portion and information corresponding to the driving torque of the image bearing member detected by the detecting member and the number of image formed sheets.

2. The image forming apparatus according to claim 1, wherein the controller determines a developer amount on the image bearing member slipping through the cleaning member based on the specification information acquired by the acquiring portion and the driving torque of the image bearing member detected by the detecting member, and controls the notifying member to notify of the lifetime of the charging member based on information corresponding to the determined developer amount and the number of image formed sheets.

3. The image forming apparatus according to claim 2, wherein the controller determines an angle between a tangent line when the developer on the image bearing member is in contact with the cleaning member and a front surface of the image bearing member based on the specification information and the driving torque of the image bearing member, and in a case in which the determined angle is small, determines that the developer amount on the image bearing member slipping through the cleaning member is large compared to a case in which the determined angle is large.

4. The image forming apparatus according to claim 3, wherein the controller determines the angle between the tangent line when the developer on the image bearing member is in contact with the cleaning member and the image bearing member, with reference to a table in which the driving torque of the image bearing member, the specification information, and the angle between the tangent line when the developer on the image bearing member is in contact with the cleaning member and the image bearing member are associated each other.

5. The image forming apparatus according to claim 2, wherein in a case in which the driving torque of the image bearing member is large, the controller determines that the developer amount on the image bearing member slipping through the cleaning member is large compared to a case in which the driving torque of the image bearing member is small.

6. The image forming apparatus according to claim 1, wherein the acquiring portion acquires a hardness of the cleaning member, a contact angle of the cleaning member with respect to the image bearing member, and a contact pressure of the cleaning member with respect to the image bearing member, as the specification information.

7. The image forming apparatus according to claim 2, wherein the controller corrects a determination value of the developer amount on the image bearing member slipping through the cleaning member based on a density value of a formed image.

8. The image forming apparatus according to claim 1, wherein the image bearing member, the charging member, and the cleaning member are provided in an image forming unit which is detachably attachable with respect to a main body of the image forming apparatus, and the image forming unit includes a storing portion which stores the specification information readable by the acquiring portion.

9. The image forming apparatus according to claim 1, further comprising:

a motor which rotatively drives the image bearing member, wherein the detecting member detects the driving torque of the image bearing member based on a current value flowing through the motor.

* * * * *